US008286461B2

(12) United States Patent
Hofmann et al.

(10) Patent No.: US 8,286,461 B2
(45) Date of Patent: Oct. 16, 2012

(54) HAND-OPERATED PLIERS

(75) Inventors: Horst Hofmann, Unterschoenau (DE); Thomas Wagner, Bermbach (DE); Ralf Legler, Altersbach (DE); Georg Holland-Moritz, Rotterode (DE)

(73) Assignee: Rennsteig Werkzeuge GmbH, Viernau (DE)

( * ) Notice: Subject to any disclaimer, the term of this patent is extended or adjusted under 35 U.S.C. 154(b) by 477 days.

(21) Appl. No.: 12/450,561

(22) PCT Filed: Mar. 31, 2008

(86) PCT No.: PCT/EP2008/053793

§ 371 (c)(1),
(2), (4) Date: Sep. 30, 2009

(87) PCT Pub. No.: WO2008/128854

PCT Pub. Date: Oct. 30, 2008

(65) Prior Publication Data

US 2010/0212391 A1 Aug. 26, 2010

(30) Foreign Application Priority Data

Apr. 24, 2007 (DE) ..... 10 2007 019 228
Nov. 22, 2007 (DE) ..... 10 2007 056 262

(51) Int. Cl.
*B21D 7/06* (2006.01)
*B21D 37/12* (2006.01)

(52) U.S. Cl. ..... 72/409.07; 72/409.01; 72/453.16; 29/751; 81/313; 81/348

(58) Field of Classification Search ..... 72/409.01, 72/409.07, 409.12, 409.19, 453.16, 453.04; 29/751; 81/313, 348
See application file for complete search history.

(56) References Cited

U.S. PATENT DOCUMENTS

| | | | | |
|---|---|---|---|---|
| 3,903,725 | A | 9/1975 | Rommel | |
| 4,266,419 | A | 5/1981 | Grundfest | |
| 7,155,954 | B2 * | 1/2007 | Battenfeld | 72/409.07 |
| 7,251,980 | B2 * | 8/2007 | Gallentine et al. | 81/348 |

FOREIGN PATENT DOCUMENTS

FR 2 224 253 10/1974

OTHER PUBLICATIONS

International Search Report.

* cited by examiner

*Primary Examiner* — David B Jones
(74) *Attorney, Agent, or Firm* — Collard & Roe, P.C.

(57) ABSTRACT

The invention relates to a pair of hand-operated pliers (1), in particular pressing pliers, with jaws (6, 7) and hand levers (4, 5), wherein the jaws (6, 7) are pivotable around a preferably common rotational axis (x). Furthermore, one hand lever (5) is connected by a joint to one of the jaws (7), and a pressure support is located between the hand levers (4, 5) for the formation of a toggle (K). In order to further improve a tool of this type, particularly with respect to the design of the pressure support, it is proposed that the pressure support consist of a support roller (18) arranged on one hand lever (4), and of a curved section (19) which is attached to the other hand lever (5) and which works together with the support roller (18).

13 Claims, 16 Drawing Sheets

HAND-OPERATED PLIERS

CROSS REFERENCE TO RELATED APPLICATIONS

This application is the National Stage of PCT/EP2008/053793 filed on Mar. 31, 2008, which claims priority under 35 U.S.C. §119 of German Application No. 10 2007 019 228.4 filed on Apr. 24, 2007 and German Application No. 10 2007 056 262.6 filed on Nov. 22, 2007. The international application under PCT article 21(2) was not published in English.

The invention relates to hand pliers, in particular pressing pliers, having jaws and hand levers, it being possible for the jaws to be pivoted about a preferably common axis of rotation, a hand lever, furthermore, being in addition connected in an articulated manner to one of the jaws, and a pressure support being formed between the hand levers in order to form a toggle mechanism.

Hand pliers of the type in question are known. These are used in particular in the form of pressing pliers for radial pressing operations to form pressed articles or moldings, for example sanitary fittings, or also for pressing cable connections, the tube or sleeve diameter being reduced in the process. Such hand pliers are manually actuable, and accordingly have two hand levers, one hand lever being connected in an articulated manner to one of the jaws and the other hand lever being connected possibly fixedly to the other jaw. It is also known in this respect to achieve improved lever transmission by forming a toggle mechanism between the hand levers, in order thus for the article or molding to be subjected, by means of relatively low actuating forces, to the high pressing forces required.

In respect of the prior art described above, a technical problem of the invention is to be considered that of further improving hand pliers of the type in question, in particular in respect of the formation of the pressure support.

This problem is solved first and foremost by the subject matter of the invention with this being based on the pressure support comprising a supporting roller, which is disposed on the one hand lever, and a curved part, which is secured to the other hand lever and interacts with the supporting roller. This configuration achieves improved kinematics in conjunction with the toggle-mechanism configuration. The transmission is improved and, in comparison with the known hand pliers, in particular pressing pliers, this makes it possible to achieve an increased pressing force, while the actuating force remains the same. Correspondingly, if the pressing force is the same as for the known pliers, the actuating force is significantly reduced. The selected configuration of the pressure support makes it possible to achieve a pressing force which is higher by up to 30% than that of hand pliers of the type in question. This does not depend on which hand lever the supporting roller and the curved part are disposed on. These parts form the toggle link of the toggle mechanism.

Described hereinafter are features which are important, preferably in combination with the features of the invention, but may also be important, in principle, in conjunction with just some features of the invention or on their own.

It thus also proves advantageous for the supporting roller and the curved part to interact by rolling. During the pressing operation, i.e. during the lever displacement which brings about closure of the pliers or pressing mouth, the supporting roller slides along the curved part or along a surface of the curved part which faces toward the supporting roller, the peripheral edge of this facing curved surface describing an arcuate line as seen in a plan view of the curved part. This arcuate line, rather than necessarily being uniform, may define arcuate portions which are configured differently over the length, that is to say, furthermore, each with different radii, which also relate, furthermore, to different center points. The transmission is influenced by the configuration of the curve or of the arcuate portions.

In a development of the subject matter of the invention, it is provided that the supporting roller is movable relative to a hand lever, furthermore in the sense of being disposed in a rotatable manner on the hand lever. As a result, the supporting roller travels along on the curved part during movement of the pliers, furthermore, in particular, during a closing movement of the pliers, and it thus, furthermore, moves along a curved section, the length of which is adapted to the closing or pressing operation of the pliers. Corresponding curvature of the curved part makes it possible to change, during the closing movement of the pliers, the angle within the toggle mechanism that is created. When the pliers are opened, the curved part and the supporting roller do not necessarily have to interact; accordingly, they may be spaced apart from one another, with the toggle mechanism being disabled. The supporting roller is preferably held in a rotatable manner on the hand lever, furthermore with an axis of rotation which is preferably offset parallel in space to the axis of rotation of the jaws. Within the context of the invention, however, the supporting roller may also be a for example roller-like body or lever protrusion which is not held in a rotatable manner, but interacts well with the curved part.

In a preferred configuration, the curved part is curved convexly throughout in the region of interaction, it being possible for the curvature to be defined by a uniform radius. As an alternative, a radius which changes over the length of the region of interaction of the curved part is provided. As a further alternative, the curved part may also be curved partially concavely in the region of interaction.

In order to provide adapted levels of transmission in different application cases, it is further preferably provided that the curved part is secured to the hand lever in an interchangeable manner. Use may thus be made of curved parts with different curvatures. As a further alternative, or also in combination therewith, it is also possible for the supporting roller to be secured in an interchangeable manner to the other hand lever, thus, for example, in order to provide different supporting-roller diameters.

It is further preferred for the curved part to be secured to that hand lever which is connected in an articulated manner to a jaw, so that the bearing point of the supporting roller, which is mounted on the other hand lever, and the point of rotation between the movable hand lever and jaw constitute the outer points of the toggle mechanism, and the rolling point, i.e. the point of contact between the supporting roller and the curved part, constitutes the third point, that is to say also, in a notional sense the toggle link. The curve of the curved part forms a slope via which it is possible to influence the relationship between the two limbs of the toggle mechanism, these limbs themselves always assuming a fairly advantageous spreading angle. As an alternative, it is also possible for the curved part to be secured to the other hand lever, which is connected fixedly to the associated jaw, while the supporting roller is mounted on the hand lever which is connected in an articulated manner to a jaw.

The curved part is further preferably formed on a holding portion which is part of the one hand lever and projects in the direction of the opposite hand lever. It is also possible as an alternative, and in addition also in combination therewith, for the supporting roller to be secured to the other hand lever in the region of a holding portion which projects in the direction of the opposite hand lever, so that the curved part and the supporting roller are, for example, supported beneath the axis of rotation of the jaws, and furthermore approximately centrally between the hand levers.

In a further configuration, the holding portion may be formed in a unitary fashion with the hand lever, in order to act directly on the curved part via the associated hand lever. As an alternative, it is also possible for the holding portion to be provided separately from the hand lever, it also being proposed in this respect that the holding portion can be pivoted relative to the hand lever, and the hand lever acts on the holding portion such that it carries it along in the pliers-closing direction, and in particular during closure of the pliers, via a ratchet formation. For this purpose, in a preferred configuration, the hand lever has a pivotable ratchet lever which interacts with a toothing formation of the holding portion. Advantageous handling of the pliers is achieved by the interposition of a ratchet formation of this kind. Accordingly, smaller grip spans are required, which prove advantageous in particular in constricted space conditions. For displacement back into the opening position of the pliers, a positive-lock engagement means which is separate from the ratchet formation may be provided between the hand lever and the holding portion, the positive-lock engagement means nevertheless allowing ratchet actuation.

In a further configuration of the subject matter of the invention, it is provided that in particular with the holding portion and hand lever being formed separately, furthermore in particular in conjunction with a ratchet formation, the holding portion and the associated hand lever can be pivoted about a common axis. In a preferred configuration, this common axis is, at the same time, the articulation axis of the associated jaw.

The supporting roller can be adjusted in order to change the toggle mechanism relative to the hand lever in which it is mounted, in order thus to change the supporting point on the curved part located opposite. For this purpose, it is possible to provide a manually actuable adjustment means for changing the positioning of the supporting-roller axis. A preferred configuration in this respect is one in which the supporting roller is mounted eccentrically in order to achieve the adjustment capability. Accordingly, the adjustment axis and the axis of rotation of the supporting roller are disposed eccentrically in relation to one another. The user can carry out the adjustment directly by means of a tool. It is also conceivable in this respect to have a solution in which adjustment can be achieved without using any tools.

During the closing movement of the pliers, the hand levers are guided by virtue of the supporting roller being supported on the curved part. In order to prevent the hand levers from swinging open during the opening movement of the pliers, and thus to maintain a defined disposition of the levers and of the supporting roller with curved part in relation to one another, a development of the subject matter of the invention provides that the hand levers, in the region of interaction, are secured to one another by means of a slotted guide via the supporting roller and the curved part, respectively. This slotted guide is configured such that it is possible to achieve the rolling support of the supporting roller on the curved part during the closing operation of the pliers without the slotted guide necessarily having any effect on transmission.

A safety catch is provided. This prevents the jaws from opening prior to completion of the pressing operation. It is thus ensured that the pressing operation is carried out to completion, as is necessary for proper pressing of the workpiece. It is only when the pressing operation has been completed that the safety catch releases the jaws and, via the latter, the hand levers in order to allow displacement back into the open position. The safety catch acts between the jaw and the hand lever which is connected in an articulated manner to the jaw, furthermore the toothing formation of the safety catch being formed on the jaw and the associated ratchet lever being mounted on the hand lever. For the purpose of interrupting for example incorrect pressing, the ratchet lever can be positively displaced into a release position by means of a tool or the like, so that the limbs of the pliers can also be opened prior to completion of the actual pressing operation. In order to start a new pressing operation, it is advantageous to design the safety catch such that, in first instance, the jaws have to be displaced into a fully open position of the pliers mouth.

The invention will be explained in more detail hereinbelow with reference to the accompanying drawing, which illustrates merely two exemplary embodiments and in which.

Figure 1:
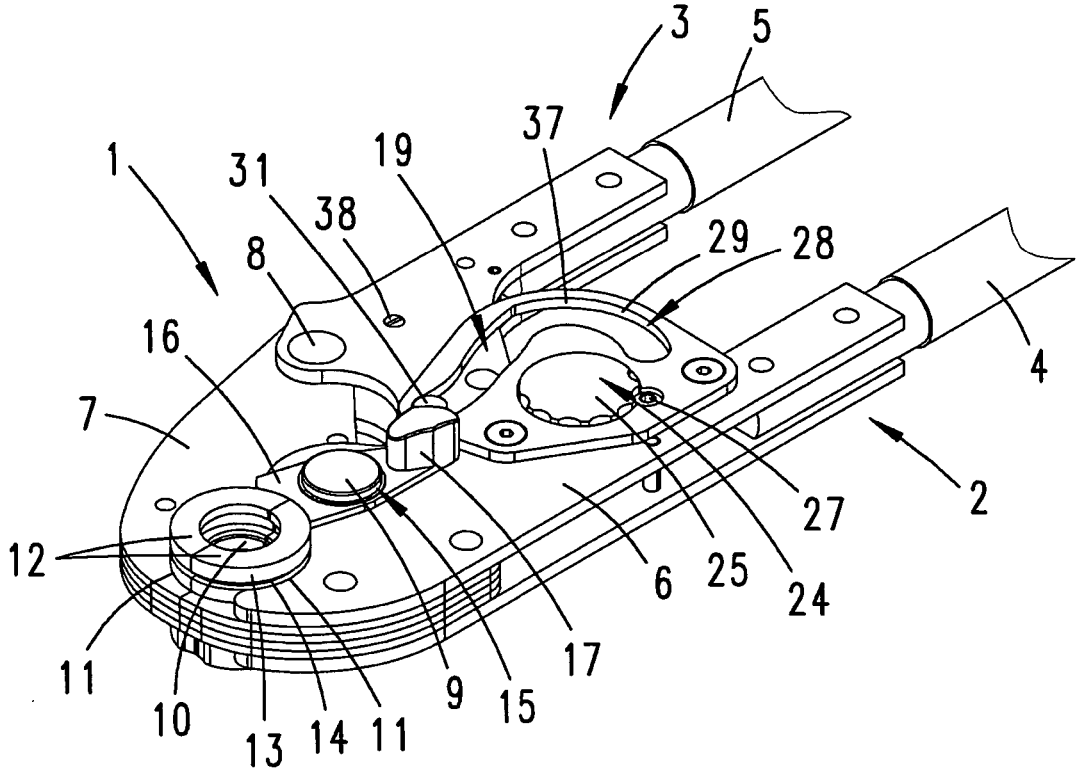
FIG. 1 shows, in perspective illustration, a view from above of the head region of a hand pliers according to the invention.
Figure 2:
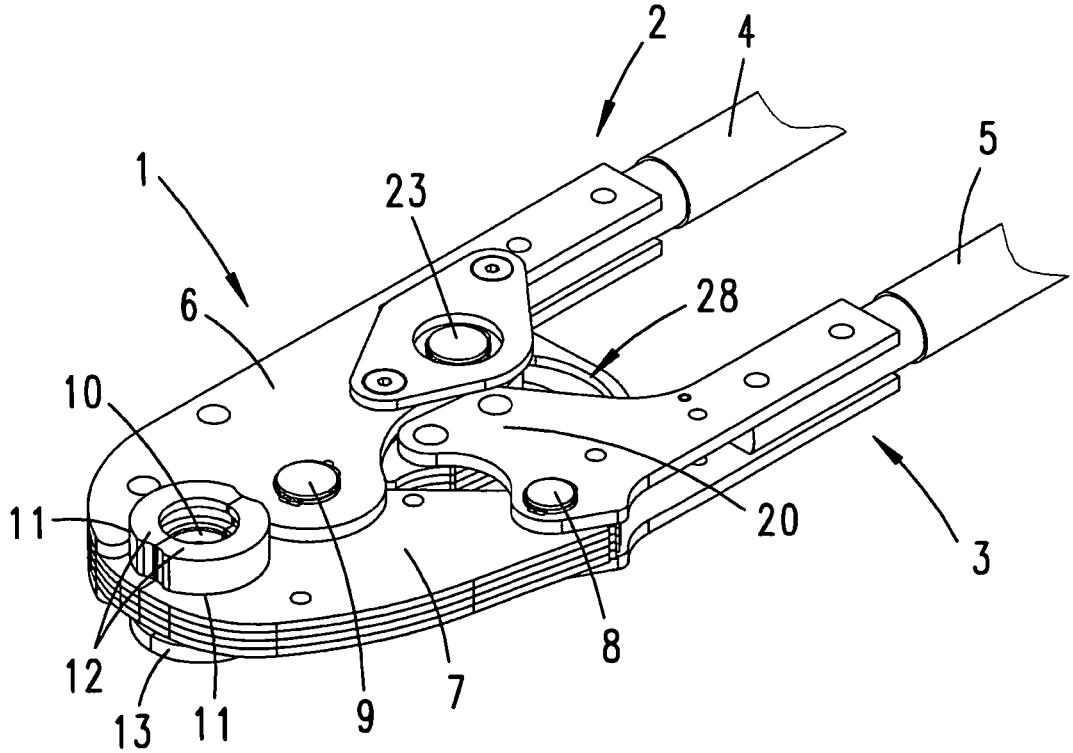
FIG. 2 shows the perspective view, from below, of FIG. 1.
Figure 3:
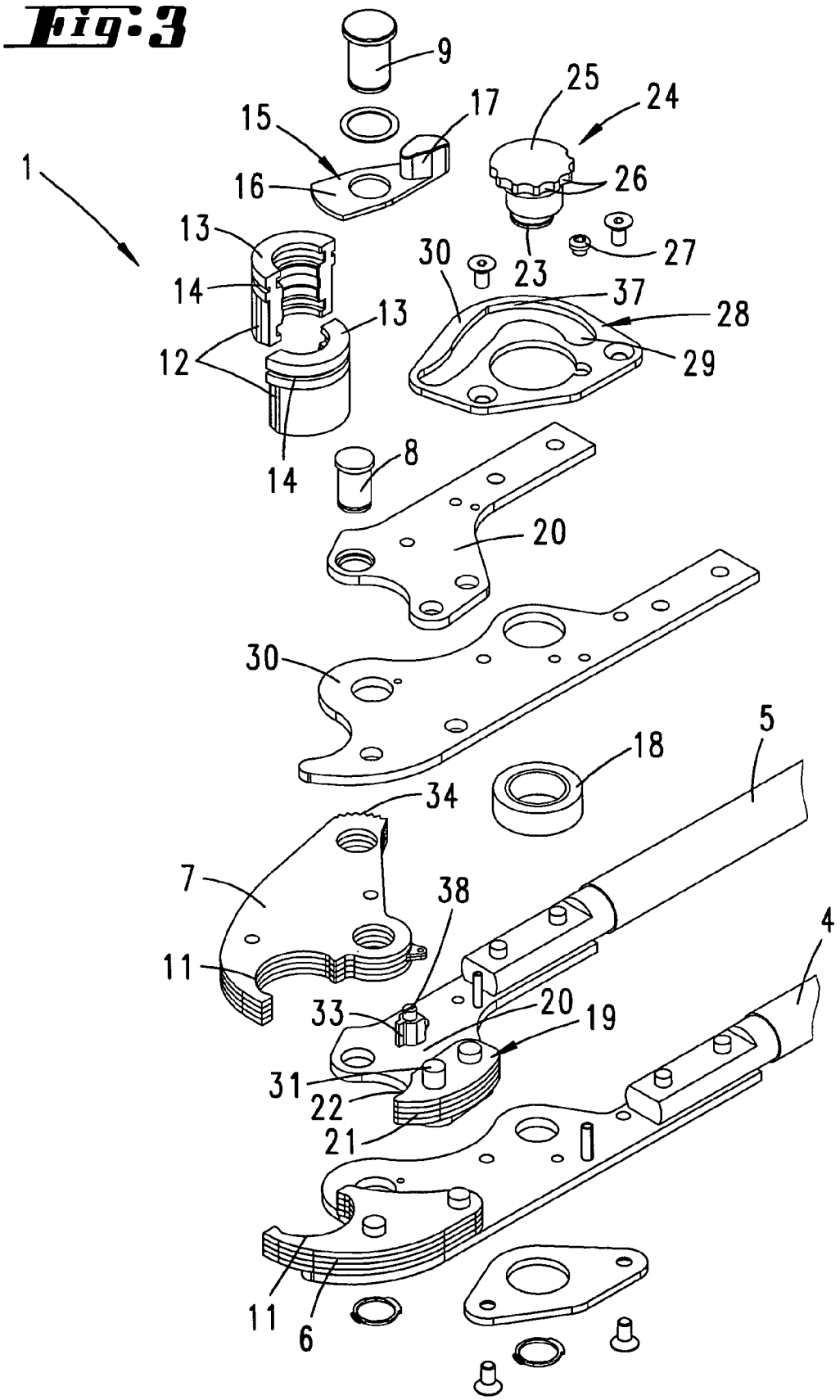
FIG. 3 shows an exploded illustration, in perspective, of the hand pliers, springs that are provided having been left out.

A hand pliers 1 in the form of pressing pliers is illustrated and described. The pliers are manually actuable, i.e. they can be operated solely by physical strength.

The pliers 1 have in first instance, in conventional form, a fixed pliers part 2 and a movable pliers part 3. The two pliers parts 2 and 3 are made up substantially in each case of a hand lever 4, 5 and of an associated jaw 6, 7.

The hand lever 4 of the fixed pliers part 2 is connected fixedly to the associated jaw 6. The hand lever 5 of the movable pliers part 3, in contrast, acts via an articulation connection 8 on the associated jaw 7, the pivot axis of which is oriented transversely to the longitudinal extent of the hand lever 4.

The pliers parts 2 and 3 are connected pivotably to one another in the region of the jaws 6, 7, in known manner, via a pivot bolt 9, the axis of the pivot bolt 9 being aligned parallel to the pivot axis of the articulation connection 8.

In the region of the end regions which are directed away from the hand levers 4 and 5, the jaws 6 and 7 form a pliers mouth 10, which can be closed and opened by means of the pivotable arrangement of the jaws 6 and 7.

Those portions of the jaws 6 and 7 which face one another and define the pliers mouth 10 each form a receiving portion 11. Half-shell-like pressing inserts 12 can be inserted positively into these receiving portions, the pressing inserts having their inner walls profiled in accordance with the desired pressing geometry. The pressing inserts 12 are pushed into the associated receiving portion 11 from a broad side of the jaws, a radially widened collar 13 of each pressing insert 12 forming a stop limit in conjunction with the broad side of the jaws 6, 7.

On the outside of its wall, the radial collar 13 of each pressing insert 12 is provided with a circumferential groove 14. A securing element 15 in the form of a planar part engages in this groove in order to secure the pressing inserts 12 in the receiving position. This securing element is held in a rotatable manner in the region of the pivot bolt 9, the axis of rotation being aligned in extension of the pivot-bolt axis 9. The securing element 15 has a blade 16, which interacts with the groove 14, and a handgrip 17, which is located diametrically opposite the blade 16.

In the exemplary embodiment illustrated, a central pliers-mouth axis is oriented parallel, in the closed position of the mouth, to the pivot axis of the pivot bolt 9. In an alternative configuration, the jaws 6 and 7, in particular in the region of the pliers mouth 10, may be angled out of the plane defined by the broad side of the jaws 6 and 7, so that the pliers-mouth axis, corresponding to the pivot axis, also assumes an in particular acute angle.

Advantageous transmission of the forces applied to the jaws 6 and 7 via the hand levers 4 and 5 is achieved by a favorable hand lever/jaw length ratio. Thus, the effective lever length in particular of the fixed pliers part 2, measured from the pivot axis x of the pivot bolt 9 to the far end of the hand lever 4 (this end not being illustrated), is approximately 15-times the spacing between the articulation axis x and the mouth axis y.

Further advantageous transmission is achieved by the formation of a toggle mechanism K. This is formed by a pressure support which, furthermore, comprises a supporting roller 18, which is disposed on the hand lever 4 that is associated with the fixed pliers part 2, and a curved part 19, which is secured to the opposite hand lever 5. The supporting roller 18 and curved part 19 interact with rolling action during a pressing operation, the pivot axis u of the articulation connection 8 between the hand lever 5 and the jaw 7 and the axis of rotation v of the supporting roller 18 constituting the outer points of the toggle mechanism K. The third point of the toggle mechanism K, that is to say, in a notional sense the toggle link, is defined by the rolling point A between the curved part 19 and the supporting roller 18.

The curved part 19 is secured to a holding portion 20 of the movable hand lever 5, this holding portion projecting in the direction of the fixed hand lever 4, and it has convex curvature 21 in the region of interaction with the supporting roller 18. The rolling on the supporting roller 18 takes place via this curved surface, which is oriented perpendicularly to the extent of the surface areas of the jaws 6 and 7, the axis of rotation v of the supporting roller likewise being aligned correspondingly perpendicularly, and thus parallel, to the pivot axes x and u and, in the exemplary embodiment illustrated, also parallel to the pliers-mouth axis y.

In the exemplary embodiment illustrated, the curvature 21 is formed by two circle portions which follow one after the other in the rolling direction and have different radii, furthermore the radius r' in a first curvature portion 21', as seen in the rolling direction, corresponding approximately to 0.4-times to 0.8-times, furthermore approximately 0.5-times, the radius r" of the curvature portion 21" which follows in the rolling direction.

The supporting roller 18, which is located opposite, is provided with a radius r''' which corresponds in terms of dimensions approximately to an average of the radii r' and r" of the curved part 19, but, furthermore, may also be less than the radius r' or greater than the radius r".

The curved part 19 forms a rounded tip in the front end region, as seen in the rolling direction, this rounded tip changing at the rear, i.e. in the direction away from the curvature 21, into a securing curvature 22, which is likewise concave in relation to the region of interaction of the supporting roller 18 and curved part 19. This curvature 22 has a radius which corresponds to the radius r''' of the supporting roller 18.

The supporting roller 18 is formed as a sliding-bearing roller. This is seated in a rotatable manner on a pin 23 of an adjusting element 24. This adjusting element 24 is mounted in a rotatable manner on the fixed hand lever 4, on both sides of the supporting roller 18, eccentrically to the supporting-roller axis v. The axis of rotation of the adjusting element 24 is designated by the reference sign w in the illustrations.

The adjusting element 24 is provided, on one side and engaging over the associated broad surface of the hand lever 4, with a plate-like securing portion 25 which is widened radially in relation to the bearing portions. In the region of its encircling periphery, over part of the circumferential length, this securing portion is provided with indent-like recesses 26. One of these recesses 26 has engaging in it a screw head 27 which engages radially inwardly over the circumference line of the securing portion 25. The adjusting element 24 is secured against rotation as a result of this positive engagement.

Guidance of the movable hand lever 5, or of the curved part 19 which is secured thereto, during the pivoting-open movement for opening the pliers mouth 10 is achieved by a slotted guide 28. The latter is formed by a guide slot 29 which is adapted to the pivoting-open movement and is formed in an extension arm 30 which is secured to the fixed hand lever 4. Engaging in this guide slot 29 is a guide pin 31 which is secured to the curved part 19 and is oriented parallel to the pivot axes.

Positively controlled slotted guidance takes place substantially only during an opening movement of the pliers and possibly during displacement of the movable hand lever 5 into a secured open position of the pliers mouth 10 and out of this position. During the actual closing operation of the pliers, i.e. during the pressing operation, the guide means is not active, or at least not with force transmission.

A safety catch 32 is provided between the hand lever 5 and the jaw 7, which is disposed in an articulated manner in relation to the hand lever. This safety catch is made up in conventional manner from a ratchet lever 33 and a toothing formation 34 which interacts therewith. The toothing formation 34 is formed at that end of the jaw 7 which is located opposite the pliers mouth 10. The ratchet lever 33 is held in a pivotable manner on the movable hand lever 5 and is loaded into a basic position via a tension spring 35. The ratchet lever 33 engages in the pivoting region of the toothing formation 34 on the jaw.

The movable jaw 7 is biased in the direction of a closing position of the mouth via a further tension spring 36, which is secured, at one end, on the jaw 7, to a radial extension atm in the region of the articulation eyelet, and, at the other end, on the fixed hand lever 4.

Figure 4:
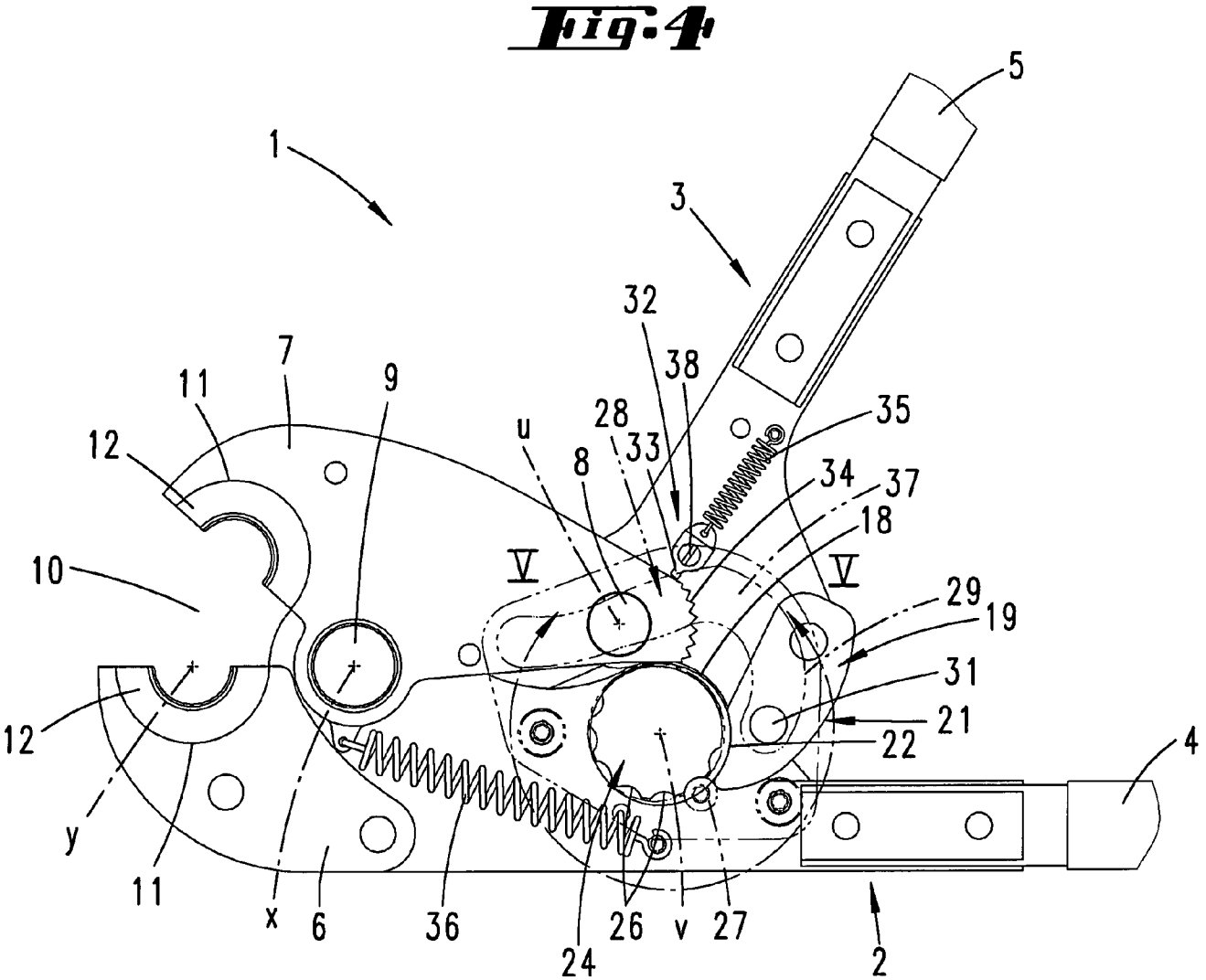
FIG. 4 shows the tool in plan view, in an open position of the pliers mouth, covering elements having been left out and the slotted guide being represented by chain-dotted lines.
Figure 5:
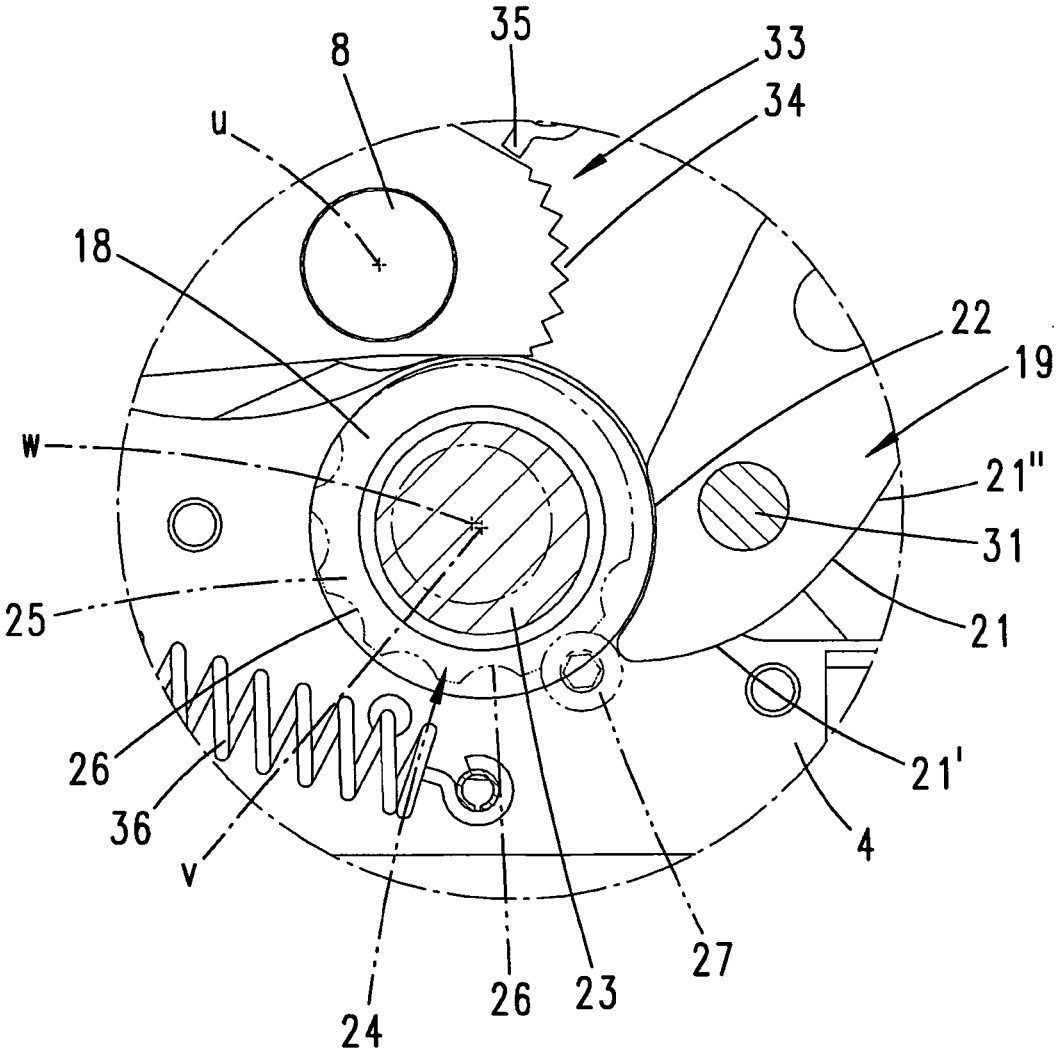
FIG. 5 shows the enlargement of the region V in FIG. 4, but shown in a section plane which is offset in relation to FIG. 4.
Figure 6:
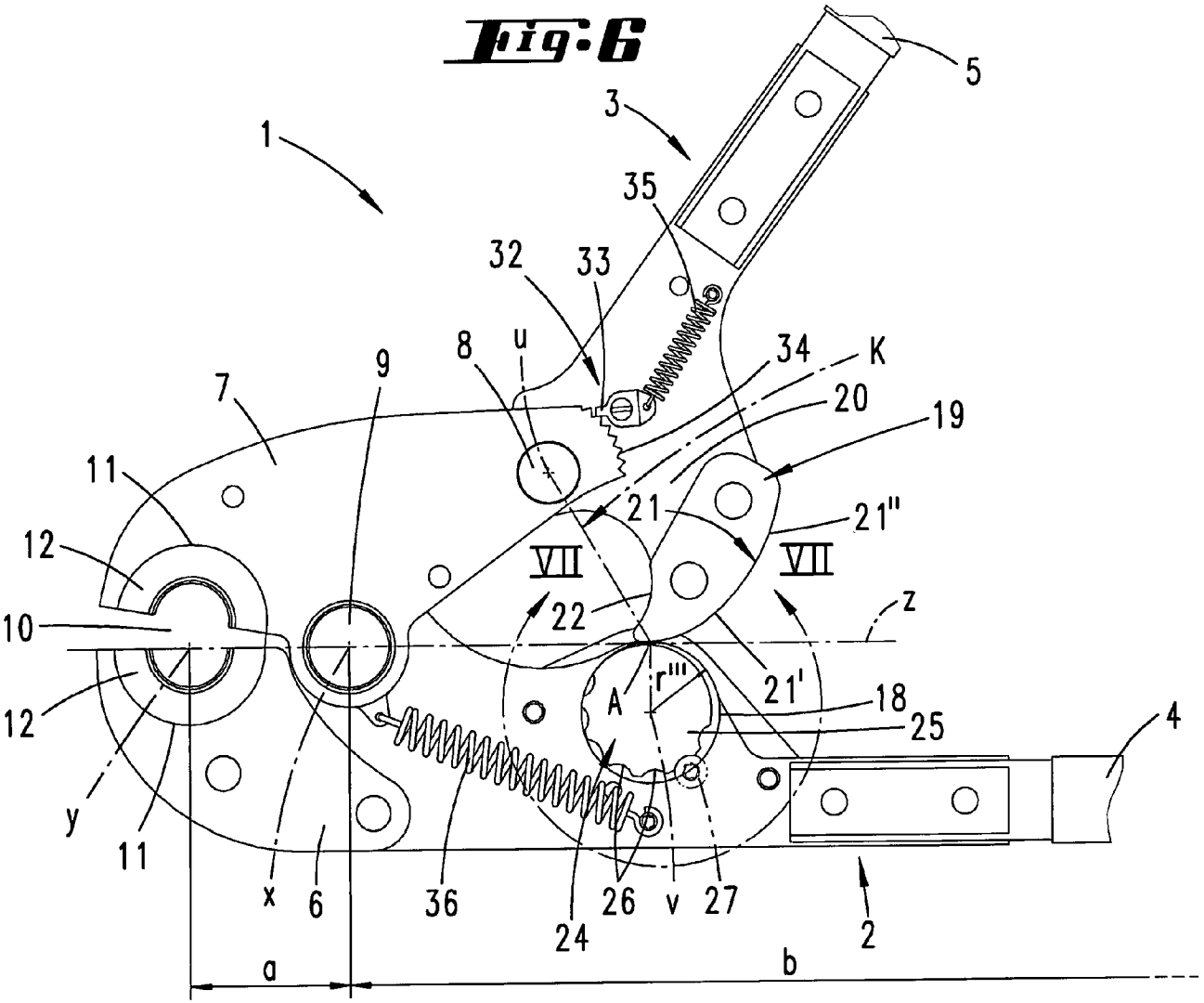
FIG. 6 shows an illustration corresponding to FIG. 4, but with the slotted guide left out, for a first intermediate position during a closing operation of the pliers mouth.
Figure 7:
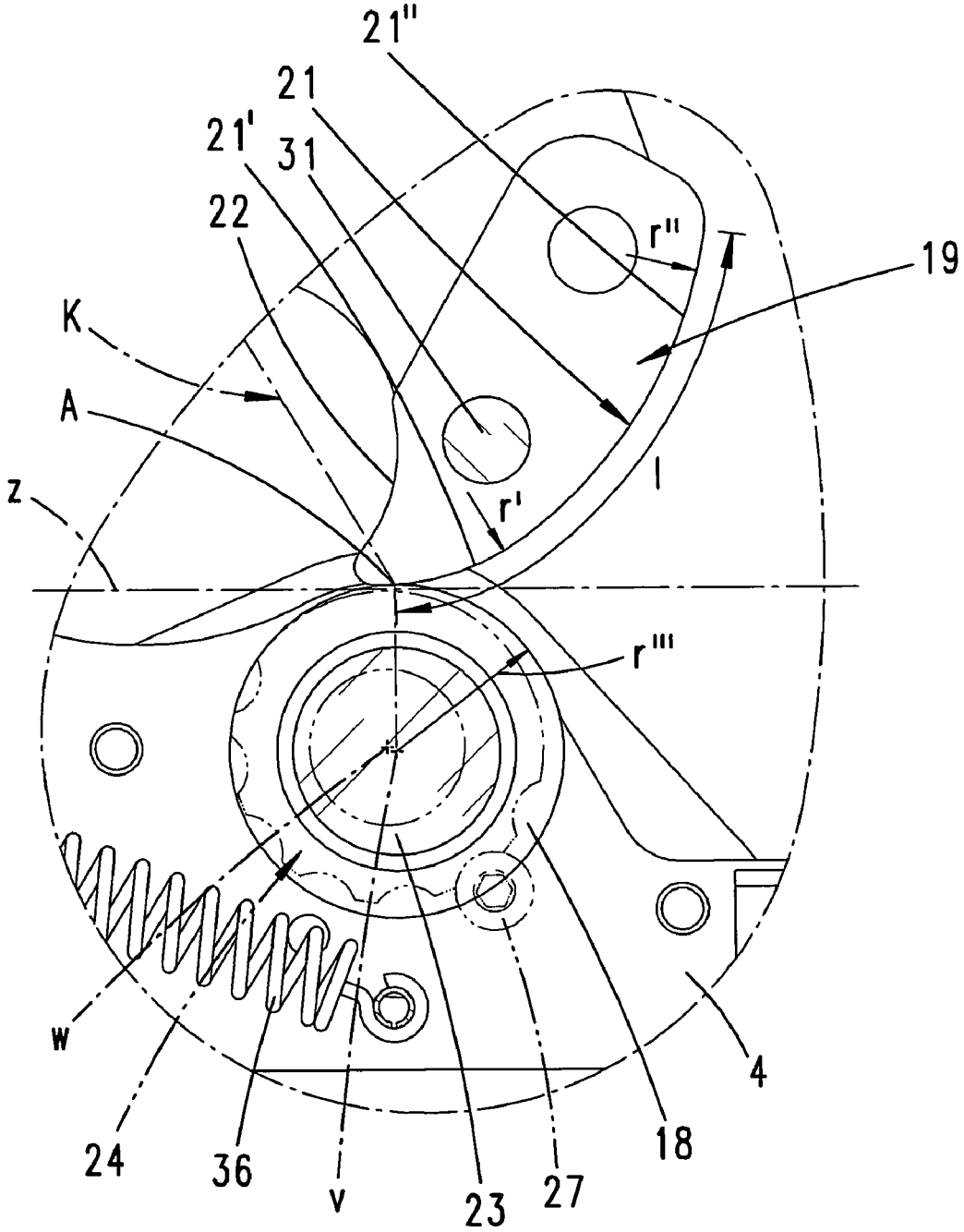
FIG. 7 shows an illustration corresponding to FIG. 5, but for the position according to FIG. 6.
Figure 8:
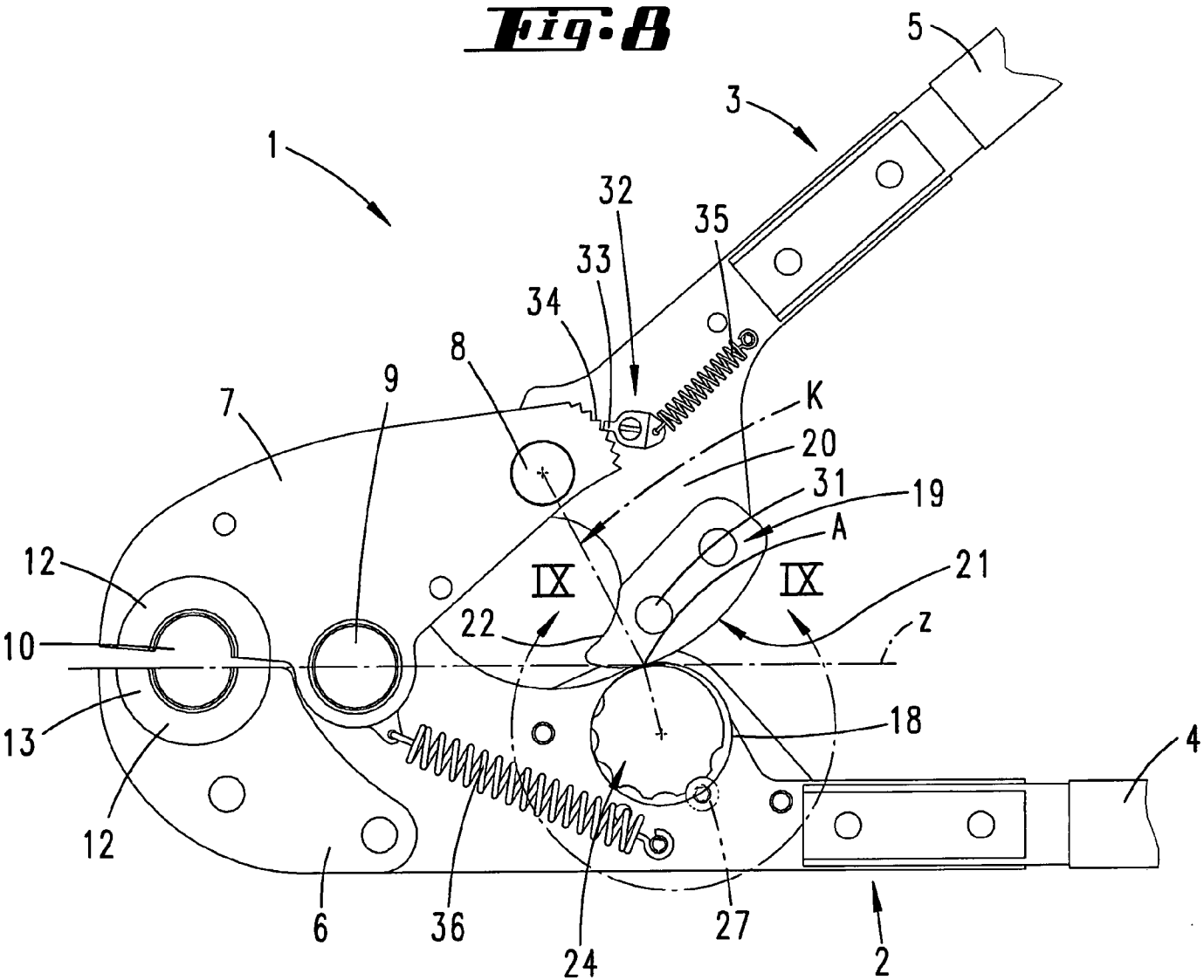
FIG. 8 shows a follow-on illustration to FIG. 6, for a further intermediate position during the closing operation of the pliers mouth.
Figure 9:
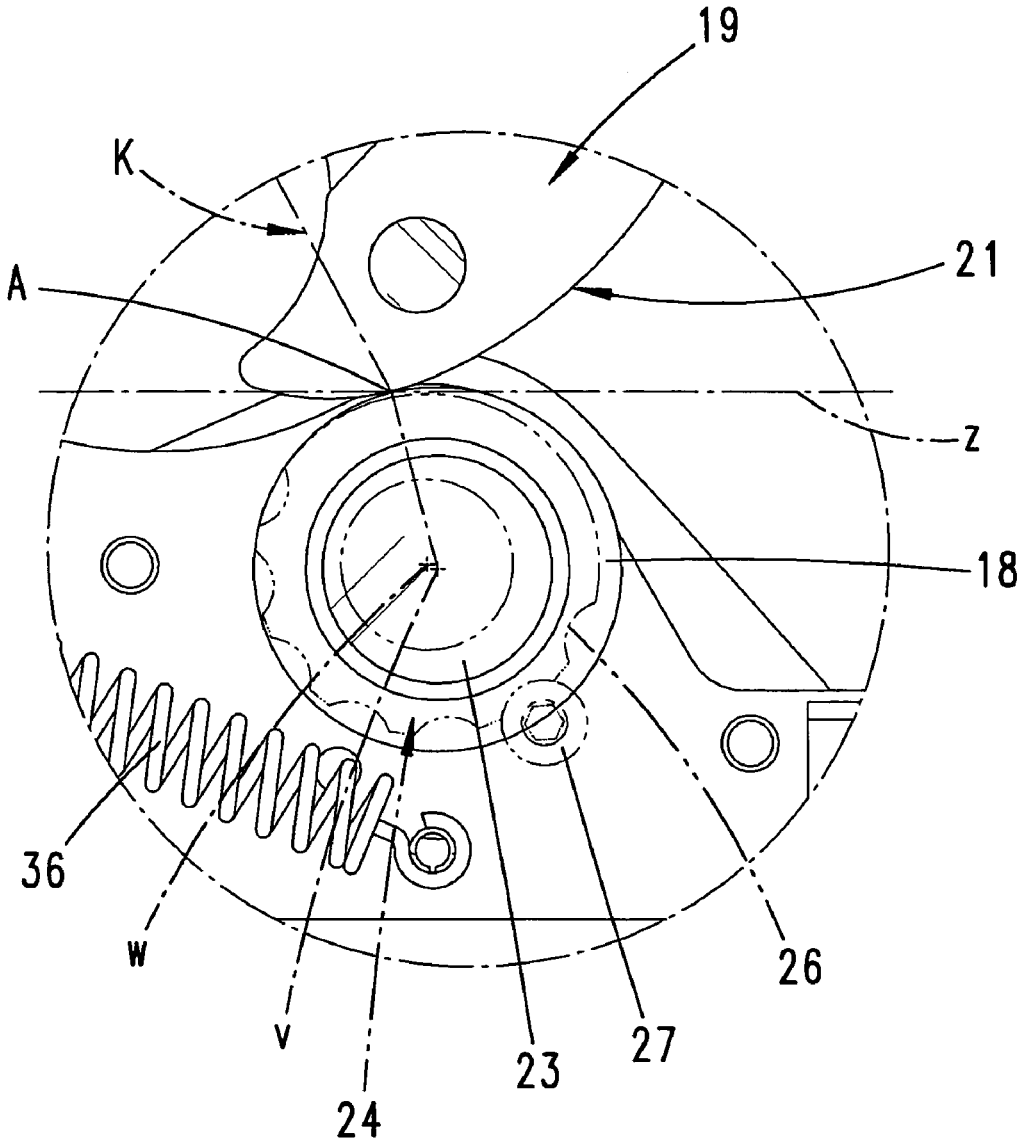
FIG. 9 shows an illustration corresponding to FIG. 7, but for the position of the pliers according to FIG. 8.

Proceeding from an opening position in preparation for fitting purposes, this being illustrated in FIG. 4, functioning and handling take place as follows:

In the pressing-insert-fitting and standby position according to FIG. 4, the pliers 1 rest in a self-retaining position, in which the pliers mouth 10 is held in the fully open position. Correspondingly, the hand levers 4 and 5 are also in a spread-apart position. With the guide pin 31 interacting with the guide slot 29, the curved part 19 has been displaced into a rear-engagement position, as seen in relation to the supporting roller 18, and in this position the securing curvature 22 engages with surface contact against the facing lateral surface of the supporting roller 18. By way of the stressed tension spring 36, the movable hand lever 5 is subjected, via the articulation connection 8, to a turning moment, thus, furthermore, in the clockwise direction as seen in relation to the illustrations. A self-retaining position is achieved as a result of the force which acts on the supporting roller 18 via the curved part 19 acting, in relation to the articulation connection 8, beneath the axis of rotation v of the supporting roller.

The ratchet lever 33 of the safety catch 32 here is located outside the engagement in relation to the toothing formation 34.

By virtue of the movable hand lever 5 being pivoted in first instance in the opening direction of the pliers 1, with the hand levers 4 and 5 being spaced further apart from one another in the process, the curved part 19, guided in the guide means 28, is displaced out of its support in relation to the supporting roller 18. For this purpose, the guide slot 29 has a reversal region 37, which is spaced apart radially from the supporting roller 18 such that the curved part 19, guided by the guide pin 31, can pivot past the supporting roller 18. The actual pressing operation begins when the curved part 19 reaches the guide-means portion which follows the reversal region 37 and slopes down slightly in the direction of the pliers head above the supporting roller 18, as seen in relation to the illustration. By virtue of the hand levers 4 and 5 being pressed together, this being accompanied by the curved part 19 being supported on the supporting roller 18, the curved part 19 rolls on the supporting roller 18 during the closing movement of the pliers. The rolling point A between the curved part 19 and the supporting roller 18 is located here throughout the entire pressing operation, i.e. over the entire closing path of the jaws, approximately on an extension of a notional connecting line between the pliers-mouth axis y and the axis x of the pivot pin (line z). A possible offset of the rolling point A in relation to the line z here corresponds, at most, to a tenth to a fiftieth of the effective rolling length 1 of the curved part 19.

Figure 10:
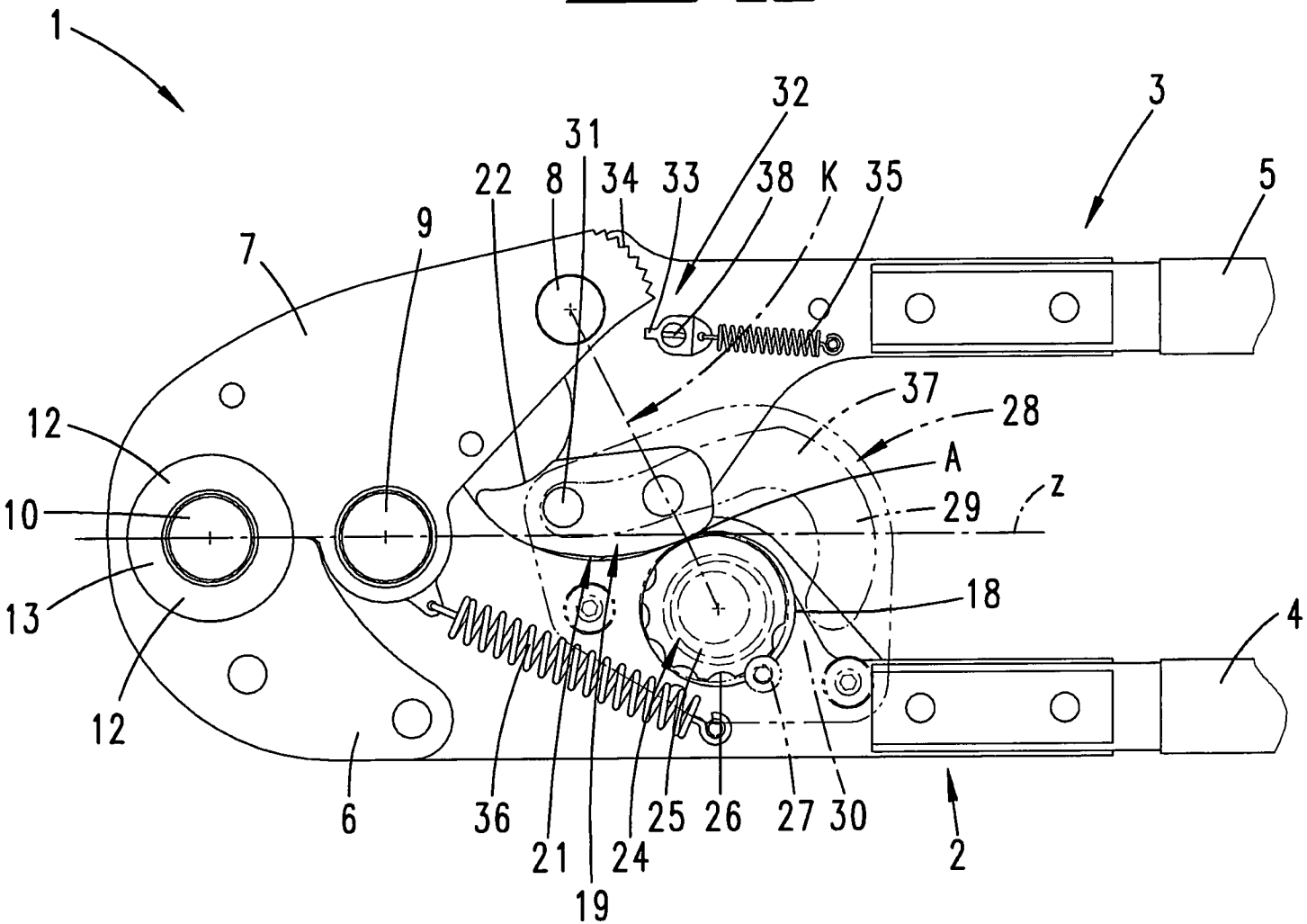
FIG. 10 shows a further illustration corresponding to FIG. 4, in this case for the closed position of the pliers mouth, i.e. the pressing position.
Figure 11:
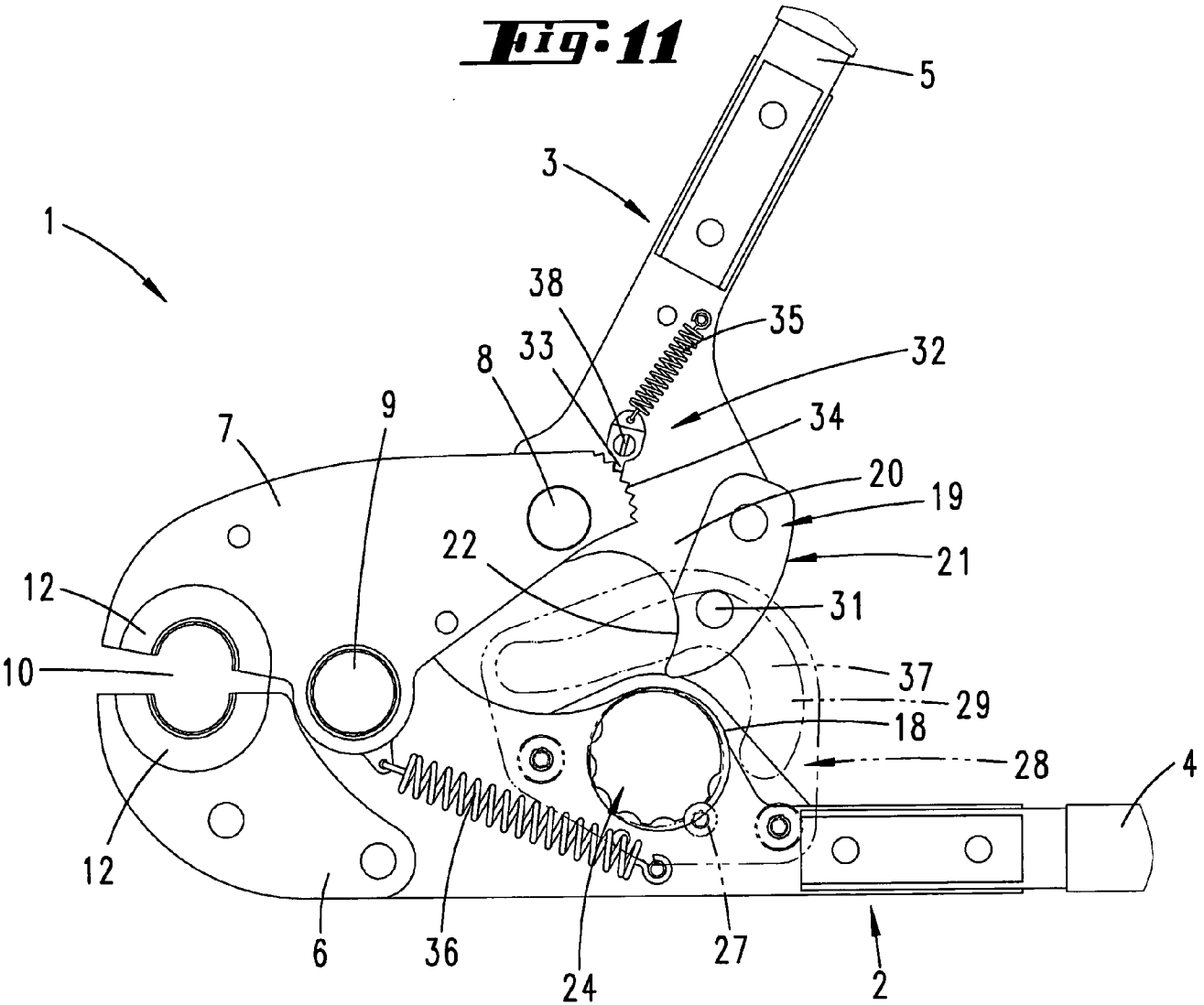
FIG. 11 shows a further illustration of the pliers, corresponding to FIG. 4, for an intermediate position during the opening operation of the pliers mouth.
Figure 12:
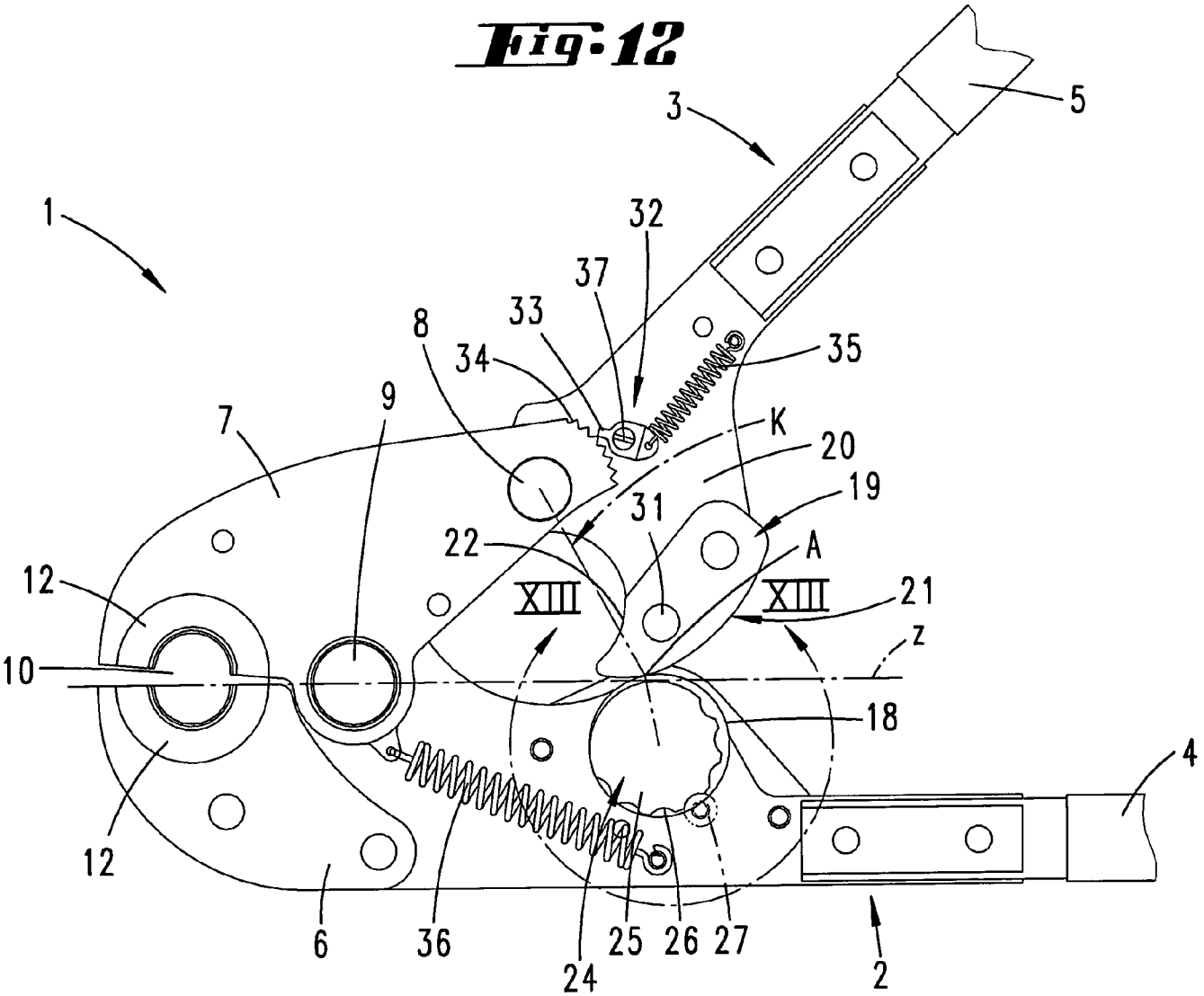
FIG. 12 shows an intermediate position corresponding to FIG. 8 during the closing operation of the pliers mouth, a toggle-mechanism setting having been changed by adjustment of a supporting roller.
Figure 13:
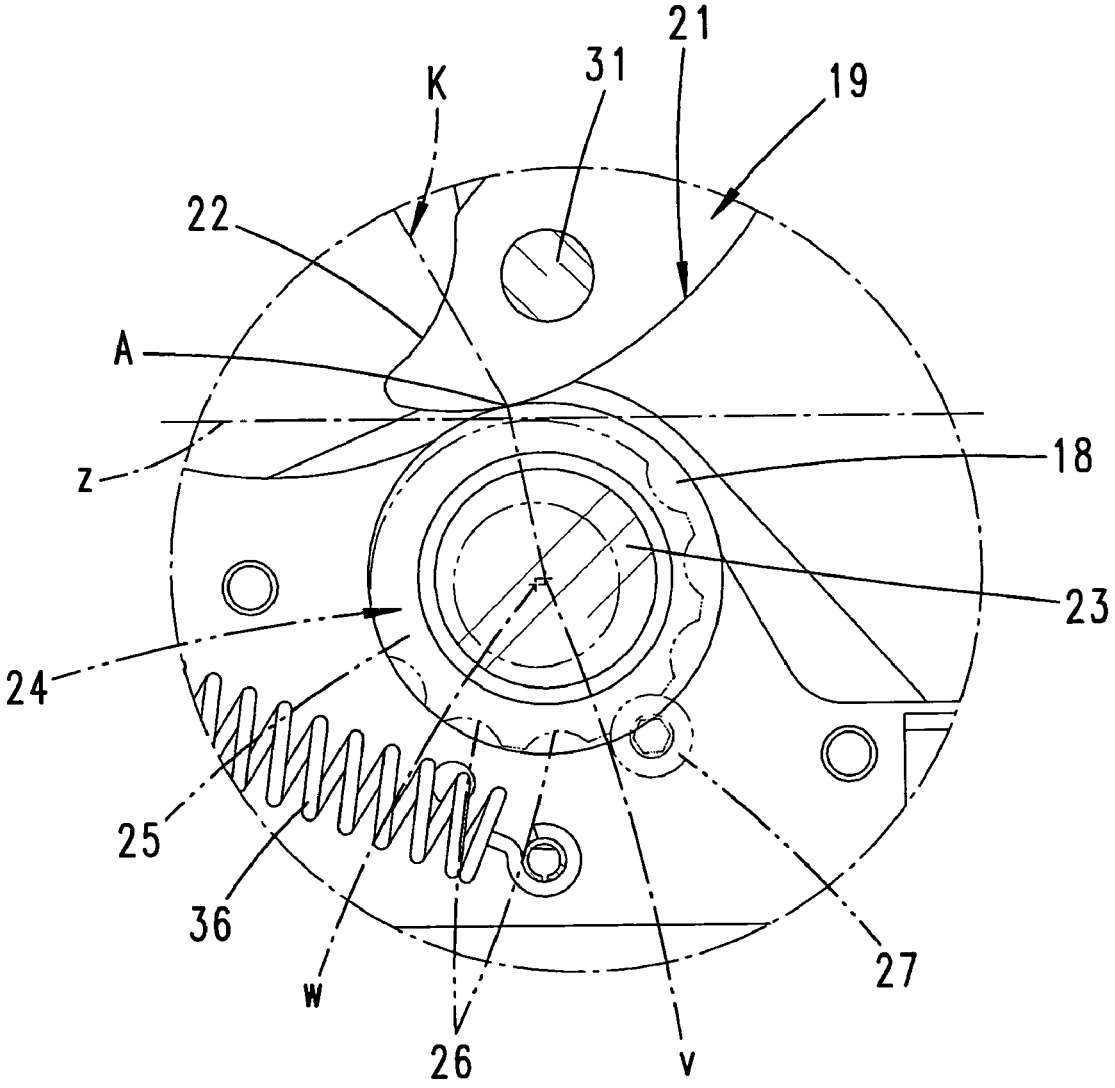
FIG. 13 shows an illustration corresponding to FIG. 9, but for the toggle-mechanism position according to FIG. 12.
Figure 14:
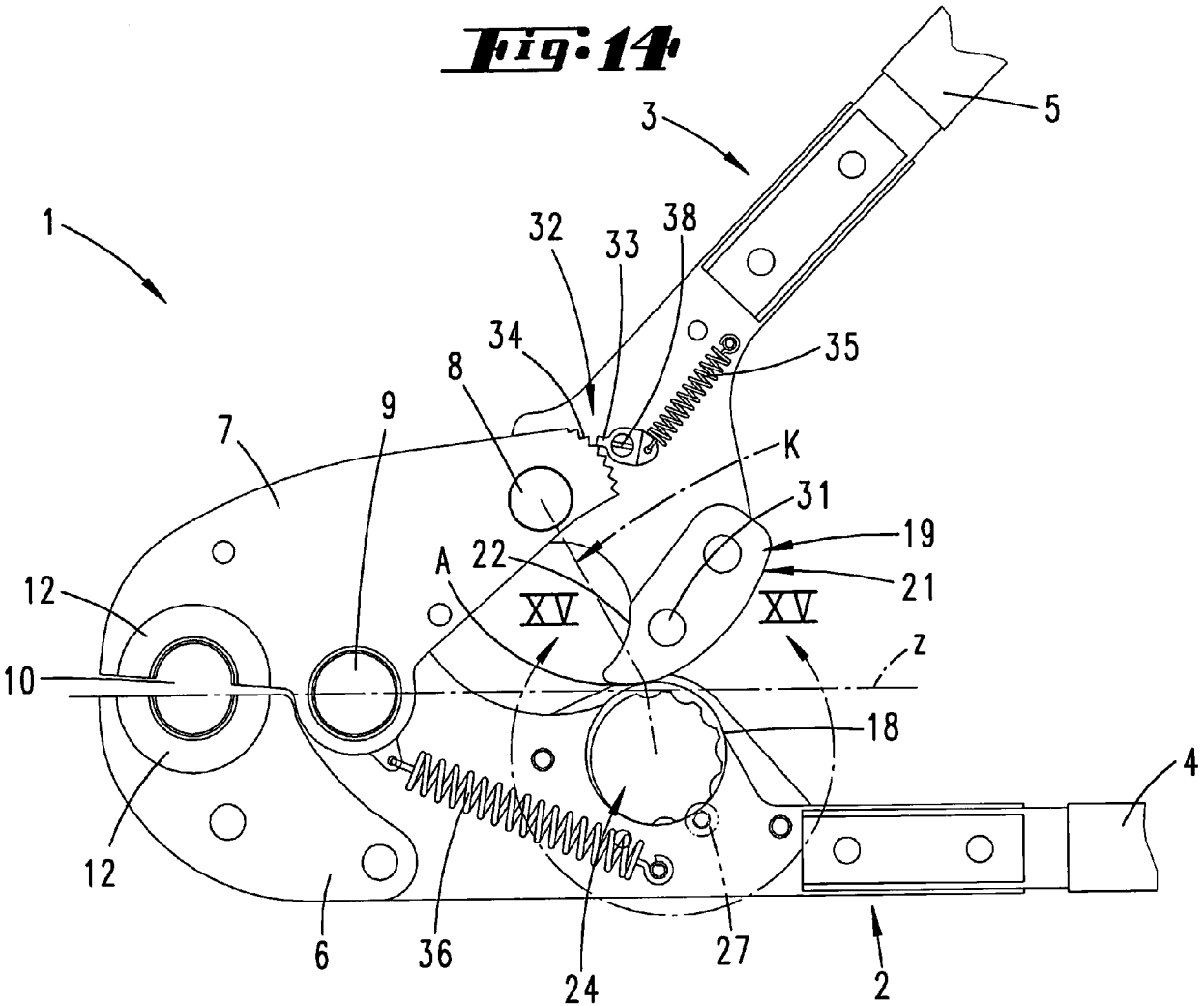
FIG. 14 shows a further illustration corresponding to FIG. 8, the supporting roller having been adjusted further in order to change the toggle mechanism.
Figure 15:
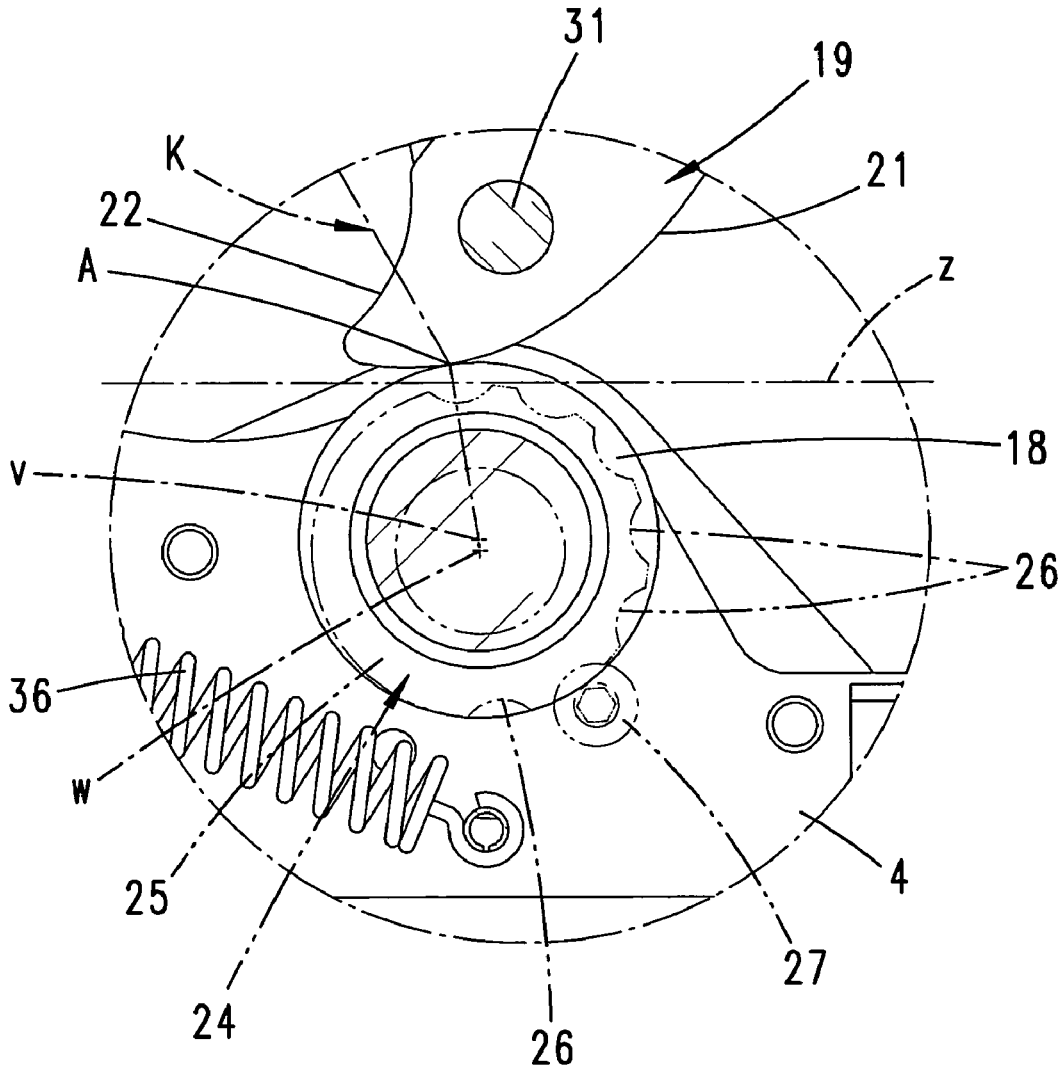
FIG. 15 shows the corresponding enlargement of the region XV in FIG. 14.
Figure 16:
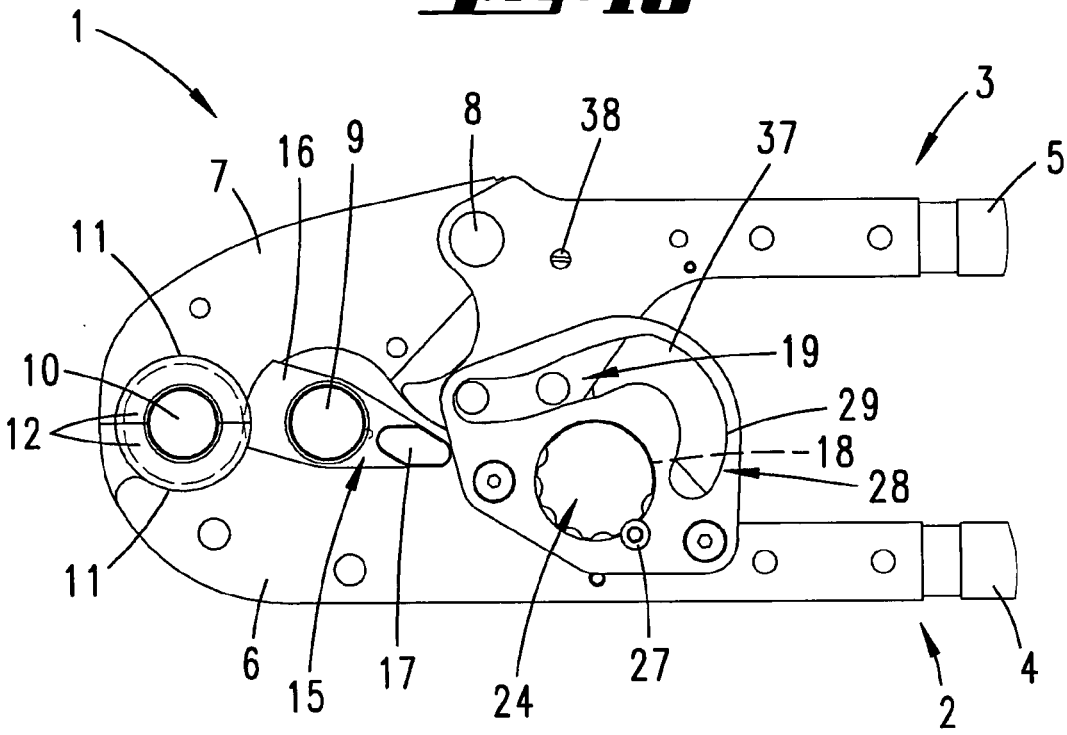
FIG. 16 shows the pliers in plan view, for the closed position of the pliers mouth.
Figure 17:
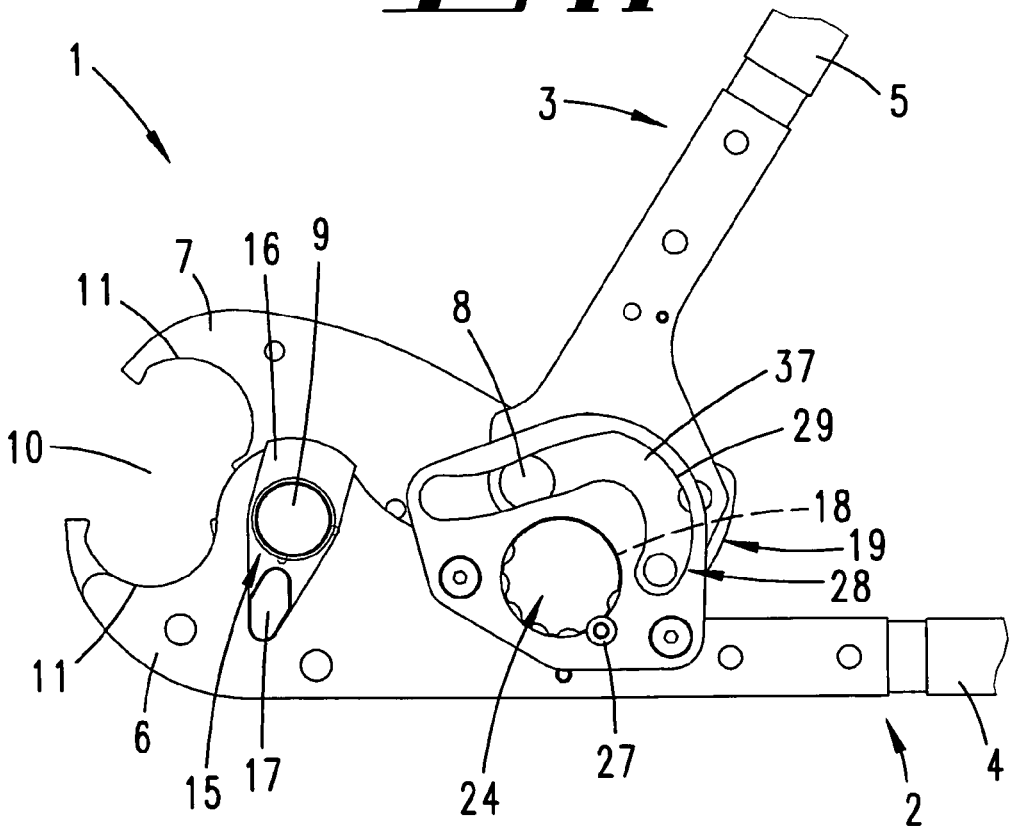
FIG. 17 shows the pliers in the open position, according to the illustration in FIG. 4, pressing inserts that are provided having been unlocked and removed.

An always advantageous toggle mechanism K, which spreads apart as the distance increases, is established over the entire pressing path, that is to say, furthermore, over the entire rolling path, this toggle mechanism, as is illustrated in FIG. 10, being spread apart to the full extent in the pressing position reached. It is not absolutely necessary for the toggle mechanism to reach this fully spread-apart position. In any case, the design is such that the dead-center position of the toggle mechanism is not over-run.

During the pressing operation, as is illustrated in FIGS. 6 to 10, the ratchet lever 33 assumes, in relation to the toothing formation 34, a position which prevents the movable jaw 7 from being displaced back prior to the closed position of the pliers mouth being reached. Accordingly, the ratchet lever 33 has a blocking effect. This ensures that the pressing operation is carried out to completion.

Upon completion of the pressing operation, the toothing formation 34 of the movable jaw 7 leaves the region of influence of the ratchet lever 33. The pliers mouth 10 can then be opened by virtue of the hand lever 5 being displaced back correspondingly, it also being the case here, during the return movement, that the ratchet lever 33 has a blocking action in relation to the toothing formation 34, albeit in this case in order to prevent a closing movement starting anew from straight after the opening movement has ceased. In order for pressing to take place again, the pliers mouth 10 first of all has to be opened to the full extent.

During the opening movement of the pliers mouth, the guide pin 31 of the curved part 19 is guided on that flank of the guide slot 29 which faces away from the supporting roller 18.

Via a tool mount 38 which is connected in a rotationally fixed manner to the ratchet lever 33, it is possible for the ratchet lever 33 to be disengaged from the toothing formation 34 for emergency-release purposes even during the pressing operation or even during the opening operation.

Adjustment of the eccentrically mounted supporting roller 18 allows adaptation of the transmission in the toggle mechanism K. Once the screw 27 has been released, the supporting roller 18 can be displaced and set, via the adjusting element 24, such that, thereafter, the respective rolling point A approaches the curved part 19, which interacts with the supporting roller 18, or moves away from this curved part (cf., in this respect, FIGS. 12 to 15). Accordingly, the spacing between the rolling point A and the line z also changes.

As a further alternative, even though it is not illustrated, the curved part 19 can be exchanged for a curved part 19 of different curvature 21.

Furthermore, the proposed solution can also be used for pliers 1 which are designed for multi-step pressing in which preferably the two handles 4 and 5 can be gripped by just one hand and high pressing forces can be achieved thereby. It is thus possible for one of the two hand levers 4 and 5, or as a further alternative also for both hand levers 4 and 5, to be provided with hand-lever portions which can be pivoted toward one another, can be latched in the respective end positions and, once a first pressing step has been carried out, are shifted into their second, latched position for further, possibly single-handed pressing.

Figure 18:
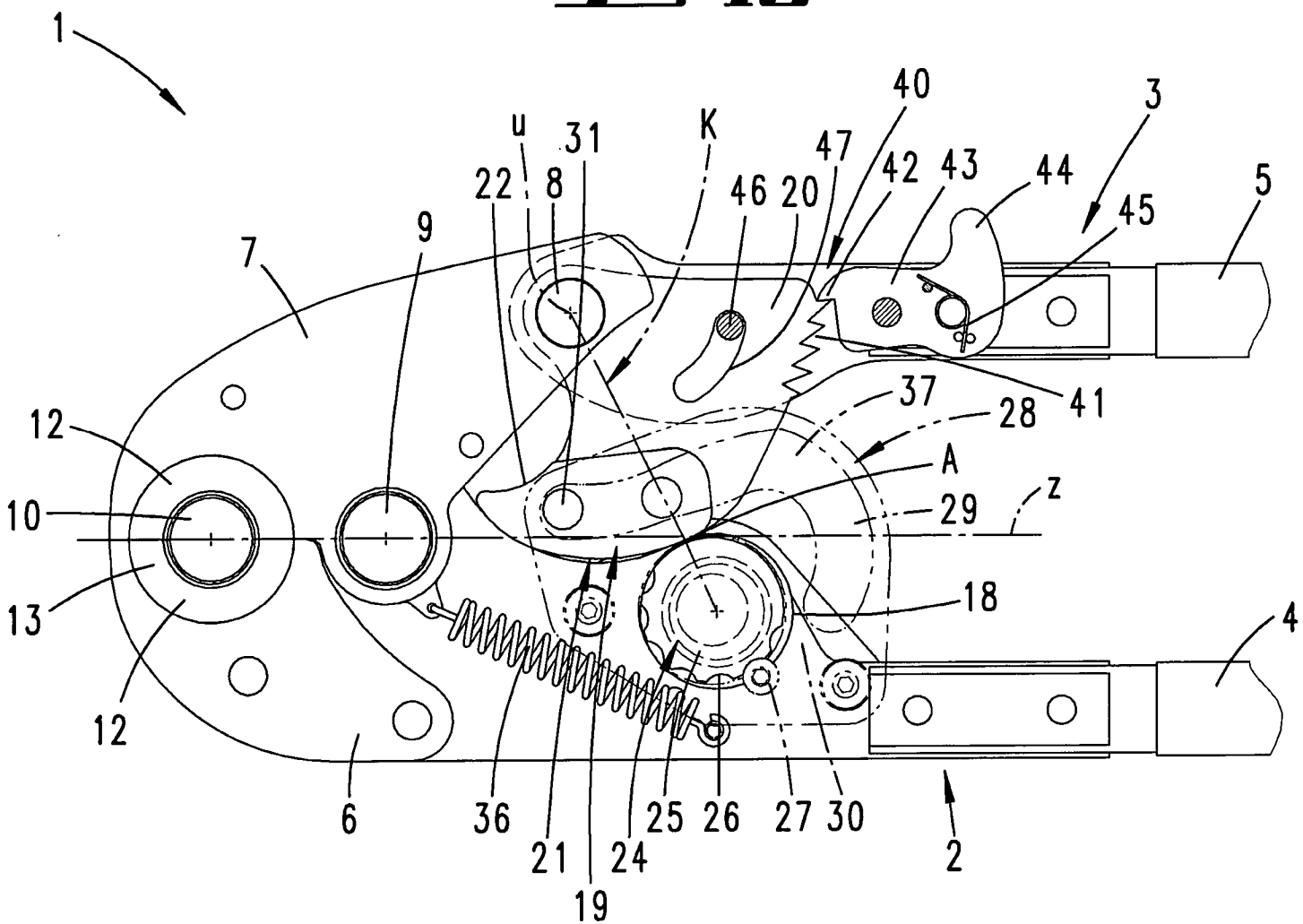
FIG. 18 shows an illustration corresponding to FIG. 10, for a second embodiment.

FIG. 18 shows an alternative configuration of the subject matter of the invention, this differing from the previously described exemplary embodiment merely in respect of the interaction of the holding portion 20 and hand lever 5.

In this second exemplary embodiment, the holding portion 20 is formed separately from the hand lever 5. The hand lever 5 is held directly on the articulation pin 8 such that it can be pivoted about the axis u. The holding portion 20 can be pivoted, as a separate part, about the same axis u, the holding portion 20 carrying the curved part 19 here as well.

The hand lever 5 and holding portion 20 interact via a ratchet formation 40. For this purpose, the holding portion 20 is provided with a toothing formation 41 in the region of a peripheral edge which faces toward the hand lever 5. This toothing formation interacts with a latching tooth 42 of a ratchet lever 43. The latter is mounted on the hand lever 5 such that it can be pivoted about an axis aligned parallel to the axis of rotation u, and it has a handling extension 44 for manual pivoting actuation in order to release the toothing engagement. The ratchet lever 43 is loaded by means of a spring 45 into the position of engagement with the toothing formation 41 on the holding portion.

Via the ratchet formation 40, with the curved part 19 and supporting roller 18 interacting, it is possible to reach the closed position of the pliers, this being done in a known manner by repeated pivoting of the hand lever 5 forward and back.

For the positive return displacement of the holding portion 20 and, via the latter, of the curved part 19 in order to reach the open position of the pliers, the holding portion 20 and handle 5 engage positively in a manner which does not impair the ratchet actuation. This positive engagement is achieved by virtue of a pin 46 on the hand lever engaging in a curved slot 47 which allows the holding portion 20 to pivot. A corresponding upward pivoting movement of the hand lever 5 results, via the engagement of the pin, in a positive return displacement of the holding portion 20.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

The invention claimed is:

1. Hand pliers (1), having jaws (6, 7) and hand levers (4, 5), said jaws (6, 7) to be pivoted about a common axis of rotation (x), a hand lever (5), furthermore, being connected in an articulated manner to one of the jaws (7), and a pressure support being formed between the hand levers (4, 5) to form a toggle mechanism (K), wherein the pressure support comprises a supporting roller (18), which is disposed on the one hand lever (4), and a curved part (19), which is secured to the other hand lever (5) and interacts with the supporting roller (18); and wherein the curved part (19) is curved convexly throughout in a region of interaction.

2. Hand pliers according to claim 1, wherein the supporting roller (18) and the curved part (19) interact by rolling.

3. Hand pliers according to claim 1, wherein the supporting roller (18) is movable relative to a hand lever (4).

4. Hand pliers according to claim 1, wherein the supporting roller (18) travels along on the curved part (19) during movement of the pliers.

5. Hand pliers according to claim 1, wherein the curved part (19) is secured to the hand lever (5) in an interchangeable manner.

6. Hand pliers according to claim 1, wherein the curved part (19) is secured to that hand lever (5) which is connected in an articulated manner to a jaw (7).

7. Hand pliers according to claim 1, wherein the holding portion (20) is mounted such that it can be pivoted relative to the hand lever (5), and the hand lever (5) acts on the holding portion (20) such that it carries it along in the pliers-closing direction via a ratchet formation (40).

8. Hand pliers (1), having jaws (6, 7) and hand levers (4, 5), said jaws (6, 7) to be pivoted about a common axis of rotation (x), a hand lever (5), furthermore being connected in an articulated manner to one of the jaws (7), and a pressure support being formed between the hand levers (4, 5) to form a toggle mechanism (K), wherein the pressure support comprises a supporting roller (18), which is disposed on the one hand lever (4), and a curved part (19), which is secured to the other hand lever (5) and interacts with the supporting roller (18) and;

wherein the hand lever (5) forms a holding portion (20) which protects in the direction of the opposite hand lever (4) and to which the curved part (19) is secured; and wherein the holding portion (20) and the associated hand lever (5) can be pivoted about a common axis (u).

9. Hand pliers according to claim 8, wherein the supporting roller (18) can be adjusted in order to change the toggle mechanism (K) relative to the hand lever (4) in which it is mounted.

10. Hand pliers according to claim 8, wherein the supporting roller (18) is mounted eccentrically in order to achieve the adjustment capability.

11. Hand pliers according to claim 8, wherein the hand levers (4, 5), in the region of interaction, are secured to one another by means of a slotted guide (28) via the supporting roller (18) and the curved part (19) respectively.

12. Hand pliers (1), having jaws (6, 7) and hand levers (4, 5), said jaws (6, 7) to be pivoted about a common axis of rotation (x), a hand lever (5), furthermore being connected in an articulated manner to one of the jaws (7), and a pressure support being formed between the hand levers (4, 5) to form a toggle mechanism (K), wherein the pressure support comprises a supporting roller (18), which is disposed on the one hand lever (4), and a curved part (19), which is secured to the other hand lever (5) and interacts with the supporting roller (18); and wherein a safety catch (32) is provided, and wherein the safety catch (32) acts between the jaw (7) and the hand lever (5) which is connected in an articulated manner to the jaw (7).

13. Hand pliers according to claim 12, wherein the toothing formation (34) of the safety catch (32) is formed on the jaw (7) and the associated ratchet lever (33) is mounted on the hand lever (5).

* * * * *